US007441985B2

(12) United States Patent
Kelly et al.

(10) Patent No.: US 7,441,985 B2
(45) Date of Patent: Oct. 28, 2008

(54) METHOD AND APPARATUS FOR PROVIDING A DOWELL CONNECTION TO MAINTAIN CAST-IN-PLACE CONCRETE SLABS IN ALIGNMENT

(75) Inventors: David L. Kelly, Sacramento, CA (US); Scott L. Collins, Roseville, CA (US)

(73) Assignee: MMI Management Services LP, Houston, TX (US)

( * ) Notice: Subject to any disclaimer, the term of this patent is extended or adjusted under 35 U.S.C. 154(b) by 246 days.

(21) Appl. No.: 11/436,690

(22) Filed: May 17, 2006

(65) Prior Publication Data

US 2007/0269266 A1 Nov. 22, 2007

(51) Int. Cl.
*E01C 11/14* (2006.01)

(52) U.S. Cl. ..... 404/56; 404/60; 404/65

(58) Field of Classification Search ..... 404/51–70
See application file for complete search history.

(56) References Cited

U.S. PATENT DOCUMENTS

| | | | | |
|---|---|---|---|---|
| 2,308,677 | A | 1/1943 | Dailey | 94/18 |
| 3,559,541 | A | 2/1971 | Walstein | 94/8 |
| 4,733,513 | A | 3/1988 | Schrader et al. | 52/396 |
| 5,005,331 | A | 4/1991 | Shaw et al. | 52/396 |
| 5,040,350 | A | 8/1991 | Panther | 52/704 |
| 5,216,862 | A | 6/1993 | Shaw et al. | 52/396 |
| 5,458,433 | A | 10/1995 | Stastny | 403/408.1 |
| 5,487,249 | A | 1/1996 | Shaw et al. | 52/396.02 |
| 5,674,028 | A | 10/1997 | Norin | 404/74 |
| 5,730,544 | A | 3/1998 | Dils et al. | 403/292 |
| 5,797,231 | A | 8/1998 | Kramer | 52/396.02 |
| 5,870,869 | A | 2/1999 | Schrader | 52/396.02 |
| 6,014,849 | A | 1/2000 | Yonemura | 52/586.1 |
| 6,145,262 | A | 11/2000 | Schrader et al. | 52/396.02 |
| 6,354,760 | B1 | 3/2002 | Boxall et al. | 404/56 |
| 6,926,463 | B2 * | 8/2005 | Shaw et al. | 404/60 |
| 2006/0127179 | A1 * | 6/2006 | Nadler | 404/47 |

OTHER PUBLICATIONS

2nd Ed. *Concrete Floors on Ground* by Portland Cement Association, Skokie, IL (1983) (14 pages).
*Guide for Concrete Floor and Slab Construction* by American Concrete Institute, Farmington Hills, MI (1997) (17 pages).
*Design and Construction of Joints for Concrete Highways* by American Concrete Pavement Association, Skokie IL (1991) (16 pages).

(Continued)

*Primary Examiner*—Raymond W Addie
(74) *Attorney, Agent, or Firm*—John K. Uilkema; Thelen LLP

(57) ABSTRACT

First and second cast-in-place concrete slabs are maintained in alignment by cutting a semi-circular groove in an edge surface of the first formed slab, positioning a flat rectangular dowel within the groove so that the dowel extends outwardly from the edge surface, and then casting the second slab against the edge surface to embed the dowel within the second slab. A gasket is engaged with the dowel to seal the groove against the intrusion of fluid concrete as the second cast-in-place. The gasket also serves to space the dowel from the groove to accommodate limited lateral movement of the dowel and groove relative to one another.

7 Claims, 4 Drawing Sheets

OTHER PUBLICATIONS

*Design and Construction of Joints for Concrete Streets* by American Concrete Pavement Assoiciation, Skokie, IL (1992) (11 pages).

*Plate Dowels for Slabs on Ground* by Wayne W. Walker and Jerry A. Holland for Concrete International (Jul. 1998) (4 pages).

*A Solution to Cracking and Stresses Caused by Dowels and Tie Bars* by Ernest K. Schrader for Concrete International (Jul. 1991) (6 pages).

*The Proven Best-Performing Dowel is Now Here! Its Name: Diamond Dowel*™by PNA, Matthews, NC (8 pages).

* cited by examiner

METHOD AND APPARATUS FOR PROVIDING A DOWELL CONNECTION TO MAINTAIN CAST-IN-PLACE CONCRETE SLABS IN ALIGNMENT

BACKGROUND OF THE INVENTION

The present invention relates to the formation of cast-in-place concrete slabs and, more particularly, is concerned with an improved apparatus and method for maintaining juxtaposed slabs in horizontal alignment, while accommodating their expansion and contraction and relative lateral movement. It is especially concerned with such a method and apparatus wherein a flat planar dowel is slidably received within a groove cut in an edge surface of a first slab and embedded within a second slab formed against the edge surface of the first slab.

The prior art teaches various types of dowels and load transferring devices for interposition between cast-in-place concrete slabs to maintain the slabs in alignment. These dowels and devices are cast-in-place during the formation of the slabs and require some type of mechanism to support them in place during the formation process. They may also include some type of spacer which is cast-in-place to accommodate limited movement of the slabs relative to one another.

The prior art also teaches the provision of cast-in-place dowels which are of a flat planer configuration and provided with a cast-in-place sheath to accommodate lateral movement of at least one of the slabs relative to the dowel. Such an arrangement may be seen in U.S. Pat. No. 6,534,760. It also requires some type of mechanism to support the dowel and sheath during the slab formation process.

It is also known to provide biscuit dowels for the joinder of wooden parts. Such dowels are of a flat planer configuration and are glued into grooves cut into the edges of the parts to be joined. U.S. Pat. Nos. 5,458,433 and 5,730,544 are exemplary of such devices. As contrasted to the dowel and load transferring devices used for cast-in-place concrete slabs, these dowels are securely adhered in place in both of the parts being joined.

SUMMARY OF THE INVENTION

In the method, a horizontally disposed groove is cut into an edge surface of a first formed concrete slab and a planer dowel is then inserted into the groove so as to have a first portion slidable relative to the groove and a second portion extending out of the edge surface. A gasket is provided to seal the groove against fluid intrusion around the dowel. A second slab is then formed against the edge surface of the first slab, so as to embed the second portion of the dowel within the second slab.

The invention also provides an assembly comprised of a flat planer dowel proportioned for receipt within a cut groove and so proportioned as to maintain the dowel in horizontal alignment with the groove and accommodate limited lateral movement of the dowel relative to the groove. The dowel includes a portion proportioned to extend outwardly from the edge surface of a first slab within which the groove is formed and the gasket received around the dowel for engagement with the slab to seal the groove against the intrusion of fluid concrete when a second slab is cast-in-place against the first slab.

The invention also provides a combination of juxtaposed cast-in-place concrete slabs, with a groove cut into an edge surface of the first formed slab, a dowel received within the groove, and a second slab formed in place over a portion of the dowel extending outwardly of the groove. The combination also includes a gasket to seal the groove against intrusion by fluid concrete as the second slab is formed.

A principal object of the present invention is to provide a method and apparatus wherein a dowel may be placed between juxtaposed cast-in-place concrete slabs, without the requirement of special forming apparatus to place the dowel.

Another and related object of the invention is to provide such a method and apparatus wherein the dowel is a flat planer configuration to provide a large bearing area.

Still another object of the invention is to provide an assembly comprised of a flat planer dowel with a gasket received therearound to both establish the location of the dowel in the groove of a first formed slab and seal the groove against intrusion by fluid concrete of a second formed slab.

A further and more general object of the invention is to provide a flat planer dowel for maintaining juxtaposed cast-in-place concrete slabs in horizontal alignment, wherein the dowel is embedded directly in one of the slabs and extends slidably into the other.

These and other objects will become more apparent when viewed in light of the following detailed description and accompanying drawings.

DESCRIPTION OF THE PREFERRED EMBODIMENT

Figure 1:
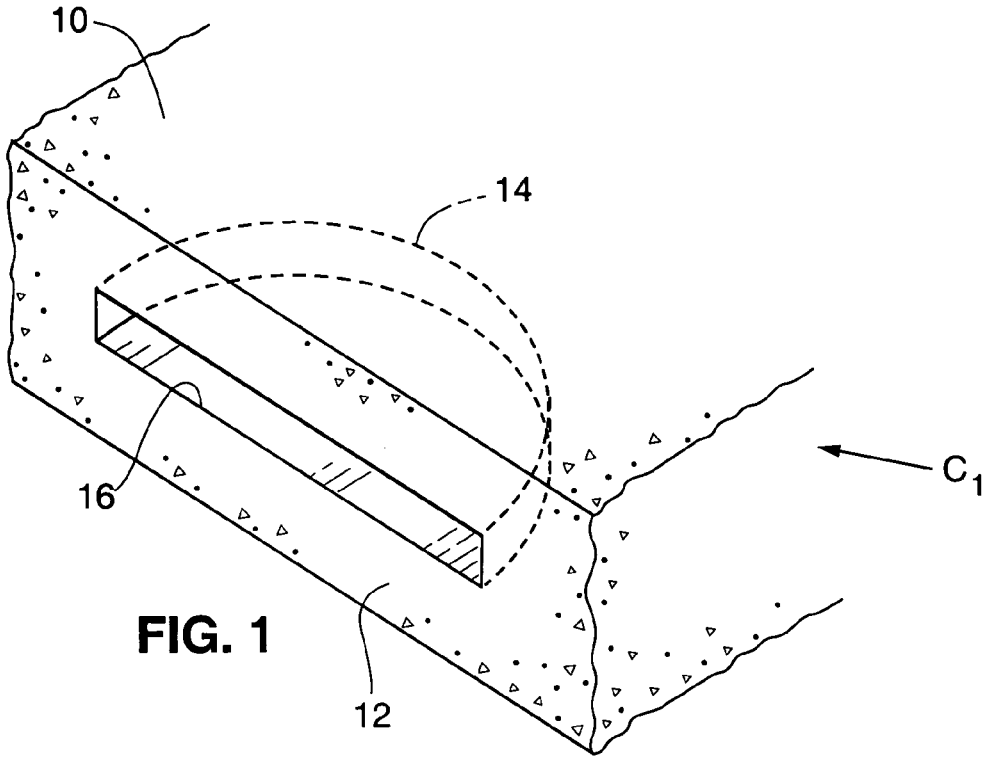
FIG. 1 is a perspective view of a first formed cast-in-place concrete slab, having a groove cut therein for practice of the present invention.

FIG. 1 shows a first formed concrete slab $C_1$ having a top surface 10 and a side edge surface 12. A groove 14 is cut through the side edge surface 12 and extends into the body of the slab. The opening of the groove, designated 16, is rectangular.

Figure 2:
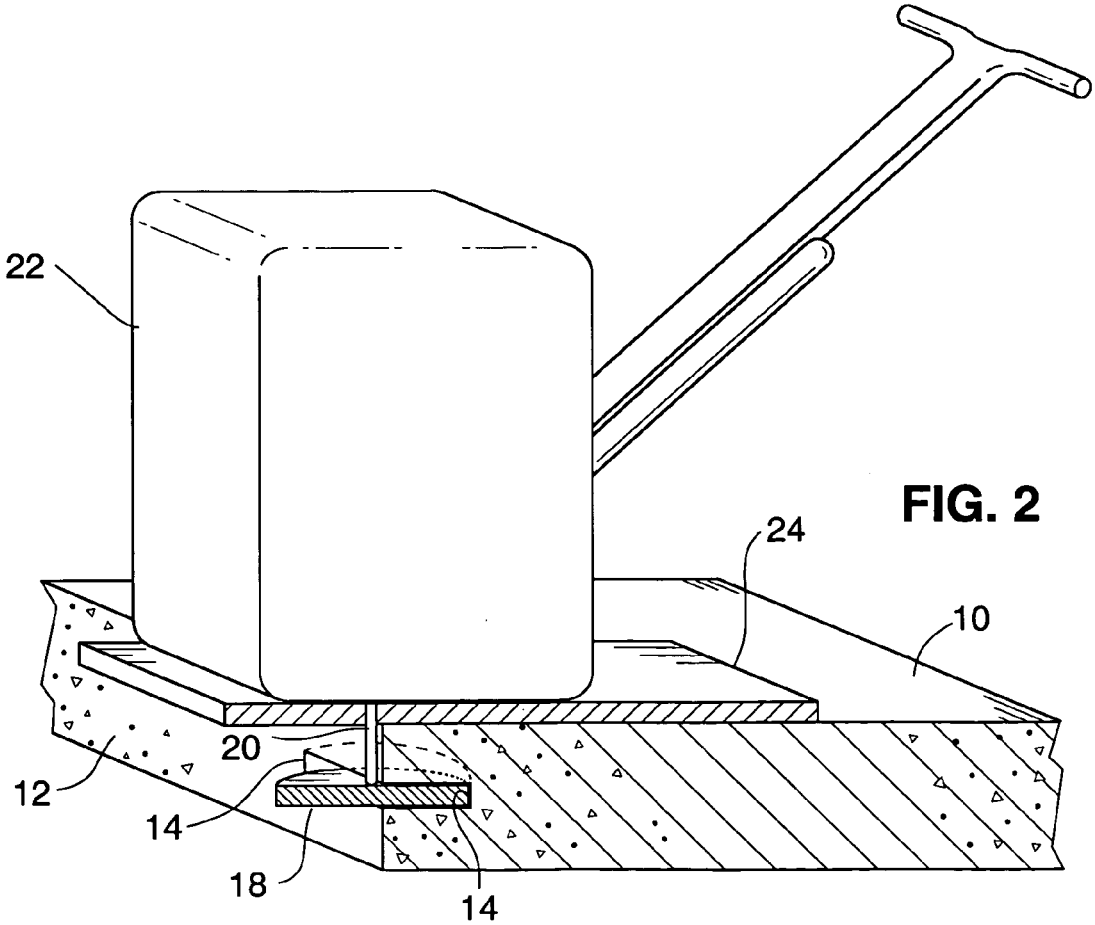
FIG. 2 is a perspective view, diagrammatically illustrating a power driven circular saw in the process of cutting a groove of the type shown in FIG. 1.

FIG. 2 illustrates the groove 14 in the process of being cut into the side edge surface 12 by a circular saw 18. The saw 18 is carried by a vertical shaft 20 rotatedly driven by an internal combustion engine 22, supported on the top surface 10 by support plate 24. The support plate maintains the shaft in a condition extending normal to the top surface 10 and, together with the length of the shaft 20, establishes the elevation at which the groove 14 is cut in the edge surface 12. In a typical example, the saw 18 is 8 inches in diameter and slightly more than ⅜ inch thick. The depth of the cut may be limited by a stop carried by the plate 24, or by engagement of the shaft 20 with the side edge surface 12. While only one groove is shown in the drawings, in practice a plurality of such grooves would be cut in the edge surface of the slab, at spaced intervals.

Figure 3:
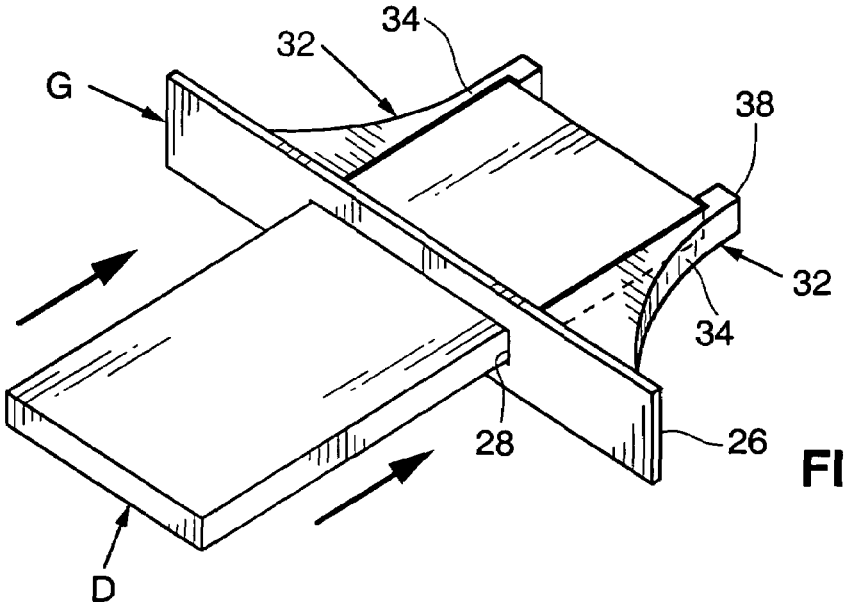
FIG. 3 is a perspective view illustrating the dowel and gasket of the present invention in the process of being assembled for insertion into a groove of the type shown in FIG. 1.

FIG. 3 shows the rectangular dowel B of the present invention in the process of being placed in a gasket G. The dowel may be formed of any suitably strong material, such as steel or fiber reinforced resin. Typical dimensions for use with a groove cut with the exemplary 8 inch saw would be 6 inches long, by 3 inches wide, by ⅜ inch thick.

Figure 4A:
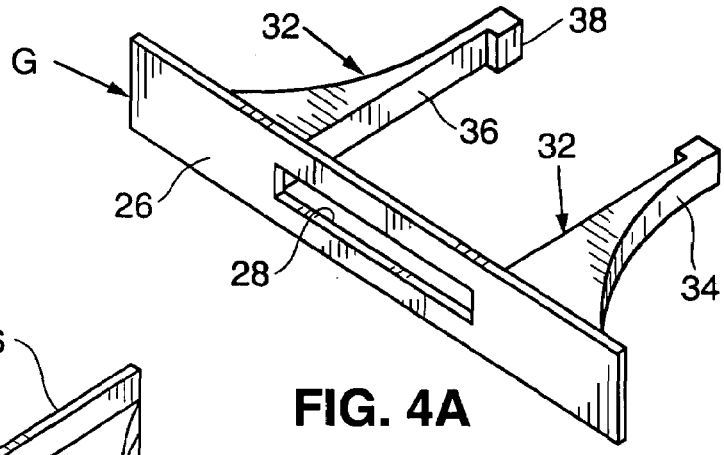
FIGS. 4A and 4B are perspective views showing the gasket of FIG. 3, without the dowel in place.
Figure 4B:
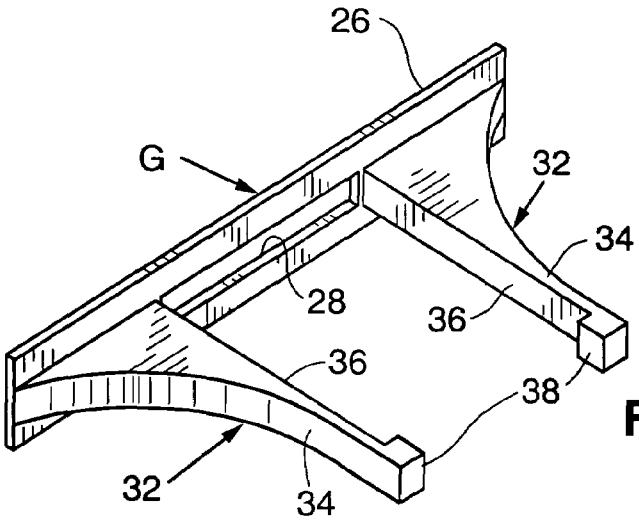
Figure 4C:
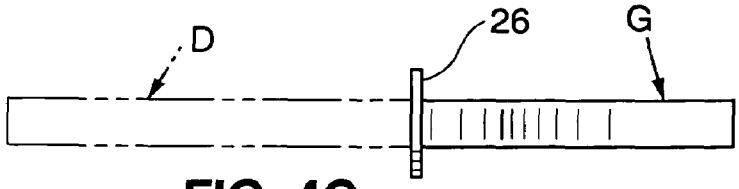
FIG. 4C is a side elevational view of the gasket shown in FIG. 3, with a phantom line representation showing the dowel received in the gasket.

The gasket G is ideally formed of a relatively soft polymer, so that it effectively seals around the dowel and against the edge surface 12 of the slab $C_1$. The detailed construction of the gasket G is shown in FIGS. 4A, 4B and 4C. There it will be seen that the gasket comprises a rectangular face 26 having a slot 28 formed therethrough for snug slidable engagement with the dowel D. Extensions 32 are formed integrally with the face 26 and extend rearwardly therefrom for engagement with opposite sides of the dowel D, as seen in FIG. 3. The extensions have arcuate outer surfaces 34 and planer inner surfaces 36. The inner surfaces terminate with stop elements 38 disposed for engagement with the inner end of the dowel D to limit extension of the dowel into the gasket and assure that space will be provided between the dowel and the groove 14, when the assembled gasket and dowel are received within the groove. This space provides for limited lateral movement of the dowel D within the groove G.

Figure 5:
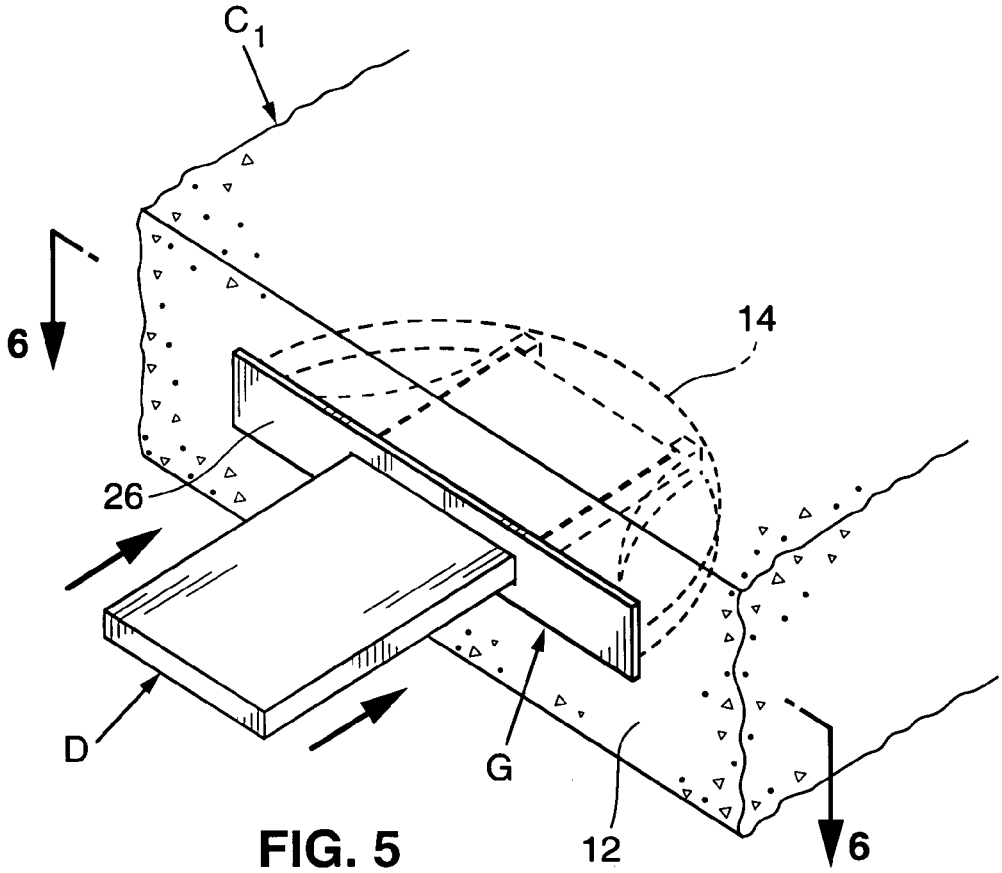
FIG. 5 is a perspective view similar to FIG. 1, illustrating the dowel and gasket assembly in place within the groove.
Figure 6:
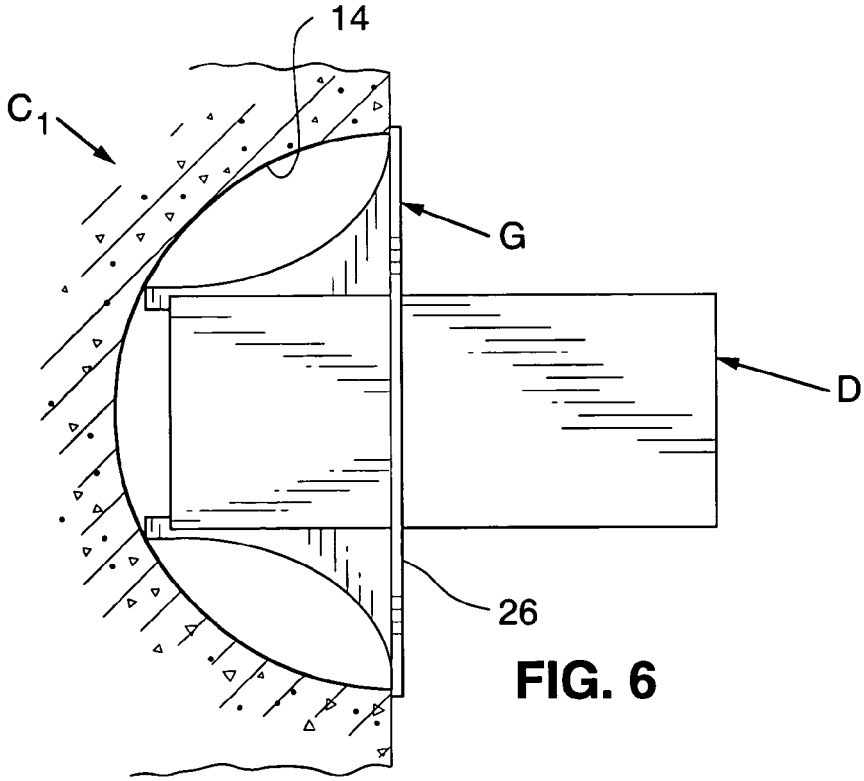
FIG. 6 is a cross-sectional view taken on the plane designated by line 6-6 of FIG. 5, illustrating the gasket assembly received within a groove cut in the edge surface of a first formed slab, with the slab broken away to show the interior of the groove.

With the dowel and gasket assembled as shown in FIG. 3, the next step is to insert the assembly into the groove 14, as shown in FIGS. 5 and 6. As there seen the inner end of the dowel is disposed in the groove 14 and the groove is sealed by the flange formed by the face 26. The inner end of the dowel D is spaced from the interior surface of the groove 14 so as to accommodate limited lateral movement of the dowel relative to the groove. The upper and lower surfaces of the dowel D are slidable relative to, and in close proximal contact with, the upper and lower surfaces of the groove 14 to maintain the dowel and horizontal alignment with the groove. The upper and lower surfaces of the groove 12 are seen in FIG. 8 and designated by the numerals 40 and 42, respectively.

In practice, the method of the present invention comprises the following steps:

1. The slab $C_1$ is first formed so as to have a flat edge surface 12.
2. The semicircular groove 14 is cut through the edge surface 12 and into the body of the slab C1, as seen in FIG. 2;
3. The assembly comprised of the dowel D and gasket G is inserted into the groove 14, as seen in FIG. 5, to seat the face 26 against the side edge surface 12, thus covering the opening 16 of the groove 14;
4. The slab $C_2$ is poured into place directly against the edge surface 12, as seen in FIG. 7.

Figure 7:
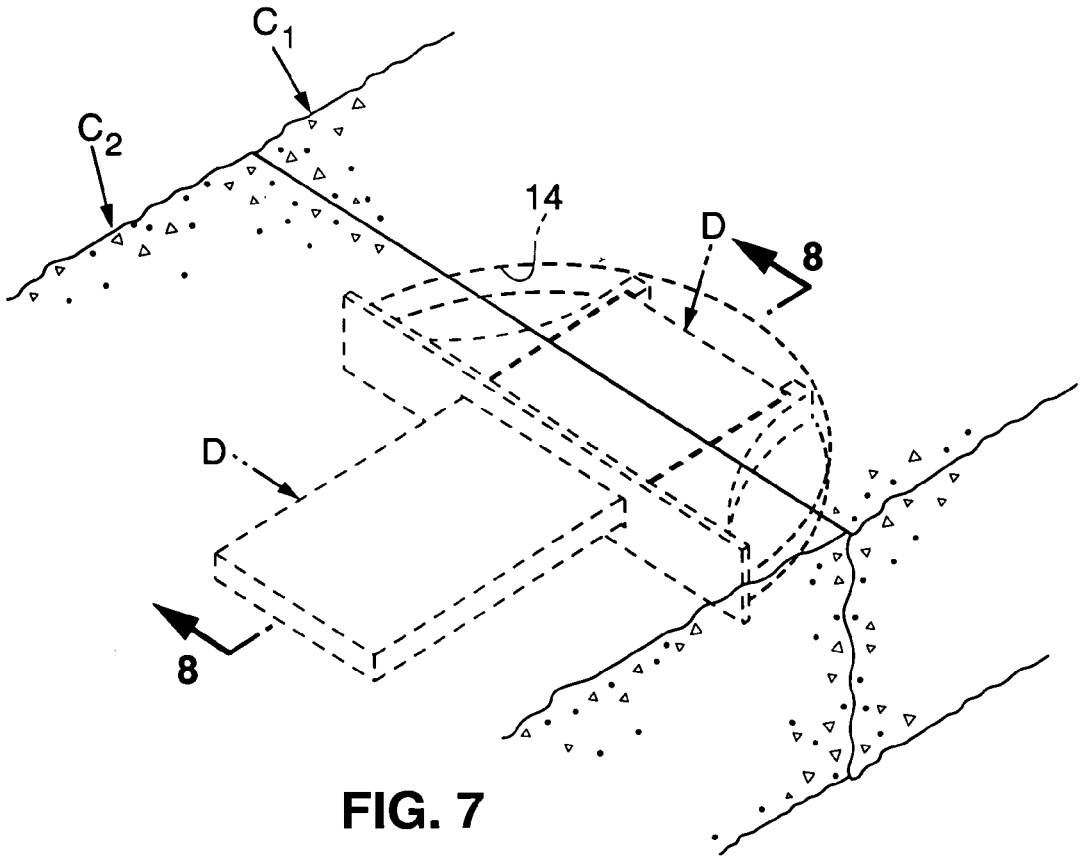
FIG. 7 is a perspective view illustrating the dowel and gasket assembly received within a groove cut in the side edge of a first formed slab, with a second formed slab cast-in-place against the side edge of the first formed slab.
Figure 8:
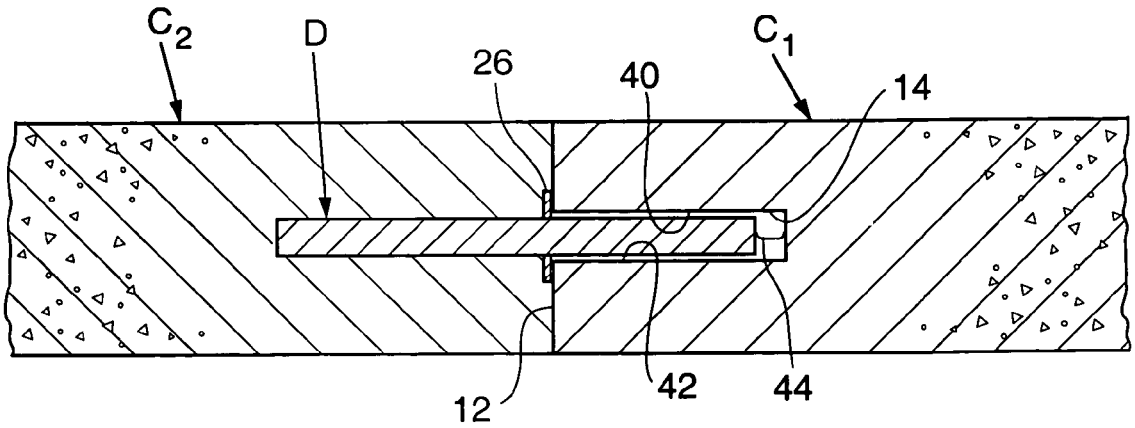
FIG. 8 is a cross-sectional view taken on the plane designated by line 8-8 of FIG. 7.

The resulting combination of the slab $C_1$ and $C_2$ is shown in FIGS. 7 and 8, wherein it will be seen that the slab $C_2$ is juxtaposed to the slab $C_1$ in direct contact with the edge surface 12. The dowel D is embedded in the slab $C_2$ and extends therefrom slidably into the groove 14, with the upper and lower surfaces of the dowel in close proximal contact with the surfaces 40 and 42 of the groove. A space 44 is provided within the groove 14 to the end of the dowel D. This space is determined by the stop elements 30. As the result of the dowel D being embedded in the slab $C_2$ and slidably received within the groove 14, the dowel serves to maintain the slabs $C_1$ and $C_2$ in horizontal alignment, while permitting limited lateral movement therebetween.

CONCLUSION

From the foregoing detailed description, it is believed apparent that the present invention enables the attainment of the objects initially set forth herein. In particular, it provides a method and apparatus for providing a dowel to maintain juxtaposed cast-in-place concrete slabs in horizontal alignment, without the requirement for special forms to place the dowel. The invention is not, however, intended to be limited to the specifics of the illustrated embodiment, but rather is defined by the accompanying claims.

We claim:

1. A dowel assembly for placement within a semi-circular horizontal groove of a given diameter cut in an edge surface of a first formed concrete slab to maintain the slab in alignment with a second formed concrete slab cast-in-place against the edge surface, said assembly comprising:

a. an elongate horizontal dowel, said dowel having:
   i. a first portion of a rectangular planar configuration with oppositely disposed side edges spaced apart by a distance substantially less than the diameter of the groove, said first portion being configured for slidable receipt within the groove to maintain the dowel in horizontal alignment with the groove and accommodate lateral movement of the dowel relative to the groove; and,
   ii. a second portion configured to extend outwardly from the edge surface when the first portion of the dowel is received within the groove;

b. a gasket received around the dowel and configured for engagement with the first formed slab when the first portion is received within the groove, to seal the groove against the intrusion of fluid concrete when the second formed slab is cast-in-place against the edge surface of the first formed slab, said gasket having narrow elongate portions engaged with and extending along the side edges of the first portion of the dowel to resiliently maintain the dowel in generally radially extending centered relationship to the groove, while permitting lateral movement of the dowel within said groove.

2. An assembly according to claim 1 wherein the gasket comprises a body snugly received around the dowel, said body having a flange extending around the dowel for engagement with the edge surface of the first formed slab and over the groove, when the dowel is received in the groove.

3. A method for casting a second formed concrete slab in place against a first formed concrete slab, said method comprising:

a. cutting a horizontally disposed semi-circular groove of a given diameter in an edge surface of the first formed concrete slab;

b. inserting an elongate horizontal dowel into the groove so that a first portion of the dowel is slidably received within the groove and a second portion of the dowel extends outwardly from the edge surface of the first formed slab, said first portion being of a rectangular planar configuration with oppositely disposed side edges spaced apart by a distance substantially less than the diameter of the groove so as to permit relative lateral movement of the first portion within the groove;

c. providing a gasket to seal the groove against fluid intrusion around the dowel, said gasket having narrow elongate portions engaged with and extending along the side edges of the first portion of the dowel to resiliently maintain the dowel in generally radially extending centered relationship to the groove, while permitting lateral movement of the dowel within said groove; and, d. forming a second slab against the edge surface of the first formed slab so as to embed the second portion of the dowel within the second slab.

4. A method according to claim 3 wherein the groove is cut in the edge of the first slab with a circular saw.

5. A method according to claim 4 further comprising supporting the saw on the first formed concrete slab to establish the elevation at which the groove is cut in the edge surface.

6. A juxtaposed pair of cast-in-place concrete slabs, comprising:

a. a first formed concrete slab having a semi-circular horizontal groove of a given diameter cut in one edge surface thereof;

b. an elongate horizontal dowel having:

i. a first portion slidabl received within the groove, said first portion being of a rectangular planar configuration with oppositely disposed side edges spaced apart by a distance substantially less than the diameter of the groove, said first portion being so proportioned relative to the groove as to maintain the dowel in horizontal alignment with the groove and accommodate lateral movement of the dowel within the groove;

ii. a second portion of a flat planar configuration integral with the first portion and extending outwardly from the one edge surface;

c. a gasket received around the dowel and engaged with the first slab to close the groove, said gasket having narrow elongate portions engaged with and extending along the side edges of the first portion of the dowel to resiliently maintain the dowel in generally radially extending centered spaced relationship to the groove, while permitting lateral movement of the dowel within said groove; and, d. a second formed slab cast-in-place against the edge surface of the first slab, with the second portion of the dowel embedded therein.

7. A pair of concrete slabs according to claim 6 wherein the gasket comprises a body snuggly received around the second portion of the dowel, said body having a flange extending over the groove and engaged with the edge surface.

* * * * *